United States Patent [19]

Dalrymple

[11] 4,087,819

[45] May 2, 1978

[54] ANTI THEFT APPARATUS FOR MOBILE RADIO ANTENNAS

[76] Inventor: Guerry M. Dalrymple, 4115 N. 57th Ave., Phoenix, Ariz. 85031

[21] Appl. No.: 732,465

[22] Filed: Oct. 14, 1976

[51] Int. Cl.[2] ..... H01Q 1/32

[52] U.S. Cl. ..... 343/715

[58] Field of Search ..... 343/715; 224/42.45 R, 224/42.46; 70/14, 15, 58

[56] References Cited

U.S. PATENT DOCUMENTS

| | | | |
|---|---|---|---|
| 3,967,275 | 6/1976 | Wagman | 343/715 |
| 4,003,228 | 1/1977 | Lievens et al. | 70/58 |

*Primary Examiner*—Alfred E. Smith
*Assistant Examiner*—Harry E. Barlow
*Attorney, Agent, or Firm*—Cahill, Sutton & Thomas

[57] ABSTRACT

A plate having a hexagonal opening for mating with a hexagonal coupling disposed at the base of an antenna is lockably secured to an element of the antenna mounting platform to preclude threaded disengagement of the antenna and its coupling from the platform.

10 Claims, 12 Drawing Figures

ANTI THEFT APPARATUS FOR MOBILE RADIO ANTENNAS

The present invention relates to anti theft devices and, more particularly, to anti theft devices for mobile radio antennas.

With the tremendous upsurge in interest of citizens band (CB) mobile radio units, theft of transceivers and antennas have increased at commensurate rates. In the past, destruction or removal of automobile mounted antennas have been primarily acts of vandalism and solutions therefor have included collapsible antennas or windshield encased antennas. However, with the increasing use of CB radios by motorists from all walks of life, unauthorized removal of the CB antennas have been primarily for the purpose of future use or sale by the thief. Consequently, such larcency is generally done with care so as not to damage or destroy the antenna or its mounting mechanism.

The known prior art, such as U.S. Pat. Nos. 2,269,974, 2,470,693, 2,536,733, 2,563,540, 3,138,661 and 3,699,580, describe various antenna mounting assemblies which render unauthorized removal more or less difficult. However, none of the devices described in these patents specifically preclude or render difficult the removal of the antenna itself from the mounting apparatus therefor. Consequently, no known prior art devices discourage or preclude unauthorized removal of the antenna itself.

It is therefore a primary object of the present invention to prevent unauthorized removal of a radio antenna from its mounting platform.

Another object of the present invention is to provide means for lockably securing an antenna to its mounting platform.

Yet another object of the present invention is to provide a lockably attached fitting for precluding threaded disengagement between an antenna and its mounting platform.

Still another object of the present invention is to provide universal locking means for precluding threaded disengagement of an antenna from its mounting platform regardless of the configuration or orientation of the platform itself.

A further object of the present invention is to provide a family of fittings for lockably securing an antenna regardless of the configuration or orientation of the antenna mounting platform.

A yet further object of the present invention is to provide a locking member which serves to lockably secure a CB transceiver to its mounting bracket or an antenna to its mounting platform.

A still further object of the present invention is to provide a locking member for CB transceivers which is compatible with all presently known CB transceiver mounting brackets.

These and other objects of the present invention will become apparent to those skilled in the art as the description thereof proceeds.

The present invention will be described with greater specificity and clarity with reference to the following drawings, in which.

Figure 1:
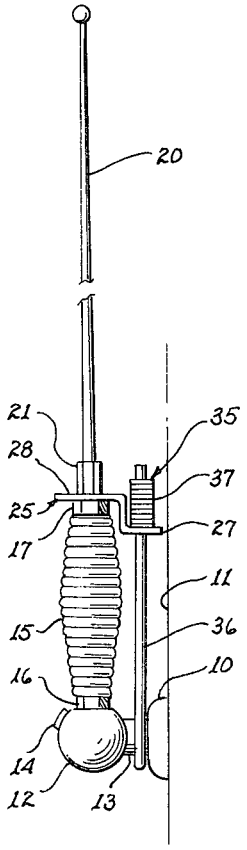
FIG. 1 illustrates an antenna secured to a vertical surface.

The present invention includes several variants and modifications thereof, all of which have been concurrently developed to meet and satisfy the various antenna mountings which might be necessary for particular CB antenna applications. FIG. 1 illustrates the most conventional and widely used antenna mountings. That is, a mounting platform is secured to a vertical surface of an automobile bumper or the vertical surface attendant a vertical panel of an automobile. Generally, a mounting plate 10 is secured to a vertical panel 11 by machine screws or nut and bolt means. A swivel ball 12 having a threaded shaft 13 extending through plate 10 is secured to the plate by nut and lock washer means (not shown). Usually, the ball is formed of two hemispheres lockably rotatable with respect to one another and positioned with respect to one another by means of an Allwn head screw 14. Thereby, the orientation of the antenna attached to the ball can be adjusted to an infinite number of positions. A coil spring 15 having nut 16 secured to one end is attached to ball 12 by means of a protruding threaded stud engaging nut 16. A further nut 17 is attached to the other end of coil spring 15 and includes a threaded stud extending upwardly from the nut. Conventional CB antennas, such as antenna 20, include an affixed hexagonal coupling 21 disposed at the base thereof. The coupling has a threaded cavity for receiving the threaded stud extending from nut 17. By employing coil spring 15 instead of a rigid mounting for antenna 20, the coil spring will bend to accommodate overhead obstructions striking the antenna during passage of the automobile and thereby reduce the possibility of bending damage or other deformation of the antenna.

From the above description of the conventional mounting shown in FIG. 1, it is apparent that disengagement of antenna 20 can be effected by simply unthreading coupling 21 from the threaded stud protruding from nut 17.

Figure 4:
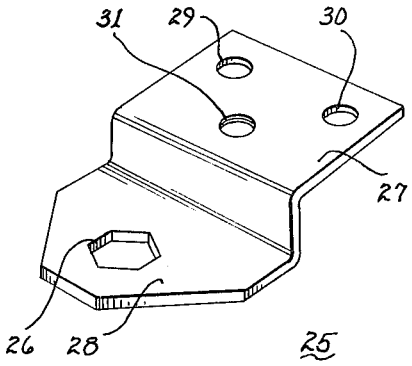
FIG. 4 is a perspective view of a fitting engaging the base of an antenna.

To preclude such unthreading of coupling 21, plate 25 (see FIG. 4) is positioned in proximity to the upper surface of nut 17 with coupling 21 penetrating aperture 26 of the plate. Normally, coupling 21 is hexagonal and aperture 26 is configured as a mating hexagonal whereby rotation intermediate the coupling and the plate is precluded. Plate 25 is configured as a "z-bend" to provide a horizontal segment 27 vertically removed from horizontal segment 28. A pair of apertures 29 and 30 are disposed within segment 27. A conventional bicycle-type lock 35 is employed to retain plate 25 in engagement with coupling 21. The semicircular base of U-shaped rod 36 partially circumscribes shaft 13 extending from swivel ball 12 and the legs of the rod extend upwardly into penetrating engagement with apertures 29 and 30 to preclude rotation of plate 25 with respect to nut 17. Locking element 37 lockably engages the protruding legs of rod 36 in proximity to the upper surface of element 27 to preclude upward movement of plate 25 with respect to shaft 13.

From the above description and with reference to FIG. 1, several conclusions become apparent. Rotation of coupling 21 cannot be performed independent of commensurate rotation of plate 25 and rotation of the latter is limited to only slight angular repositioning due to the interference created by lock 35. Thus, antenna 20 cannot be removed as rotation of coupling 21 is proscribed. Rotation of coil spring 15 in order to effect disengagement between either ball 12 or coupling 21 cannot be performed since such rotation would necessarily result in upward displacement of the coil spring, which upward displacement is restrained by lock 35 acting upon plate 25. Thereby, neither antenna 20 nor its supporting coil spring can be threadedly disengaged and unauthorized removal of the antenna is prohibited. Because lock 35 is pivotally secured about shaft 13, fore and aft pivotal movement of coil spring 15 is readily possible and thereby the cushioning effect of the coil spring is still preserved so that damage to antenna 20 through striking an overhead obstruction during movement of an automobile still remains unlikely.

Figure 2:
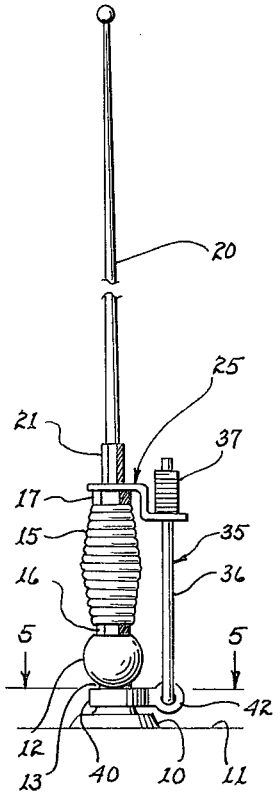
FIG. 2 illustrates an antenna secured to a horizontal surface.
Figure 5:
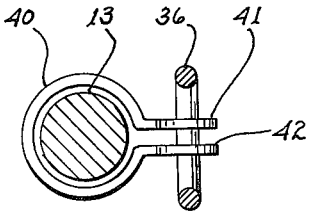
FIG. 5 is a top view of a fitting shown in FIG. 2 and taken along lines 5—5.

Referring to FIG. 2, there is illustrated another variant of the present invention which is particularly suitable for antennas having horizontal mounting platforms. Mounting plate 10 is secured, as described above, to a horizontal surface 11. Shaft 13 extending upwardly therefrom supports ball 12. Coil spring 15 is secured to the ball by means of a threaded stud extending from the ball into threaded engagement with nut 16. A further threaded stud extends from nut 17 for engagment with hexagonal coupling 21 at the base of antenna 20. Plate 25 is mounted adjacent nut 17 for penetrating and locking engagement with coupling 21 as described above. A collar 40 (see also FIG. 5) is positioned about shaft 13. Apertured arms 41 and 42 of collar 40 extend laterally for receiving the base segment of rod 36 of bicycle lock 35. The legs of rod 36 extend through apertures within plate 25 (as described above) and locking element 37 lockably receives the arms so as to draw segment 27 of plate 25 toward collar 40 until segment 26 of the plate is adjacent the upper surface of nut 17.

Because rotation intermediate coupling 21 and aperture 26 within plate 25 is precluded, antenna 20 cannot be threadedly disengaged from coil spring 15 without commensurate rotation of plate 25. Rotation of plate 25 would necessarily incur commensurate rotation of collar 40 due to the interconnecting rod 36 of lock 35; however, rotation of coupling 21 with commensurate rotation of plate 25 would necessarily raise the plate and bring about an attempt to raise locking element 37. By selecting the size of collar 40 such that pivotal movement thereof in the vertical plane is restrained due to interference with ball 12, raising of locking element 37 is precluded. Thereby, even though collar 40 does not preclude rotation of plate 25 in response to rotation of coupling 21, substantial rotational movement is precluded because the resulting commensurate upward displacement of locking element 37 is prohibited by the engagement of rod 36 with collar 40. It is assumed, of course, that the threaded stud interconnecting nut 17 and conduit 21 or the threaded stud interconnecting nut 16 and ball 12 will remain in threaded engagement during the slight permissible raising of plate 25.

Figure 3:
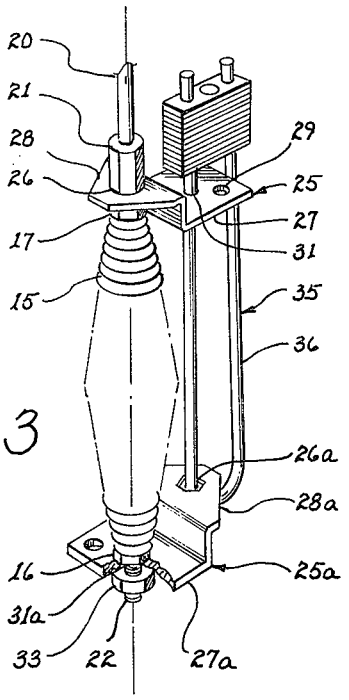
FIG. 3 illustrates a variant of an antenna lockably connected to a mounting platform.

Referring to FIG. 3, there is shown a yet further variant of the present invention for securing an antenna to a mounting platform attachable to a horizontal surface (not shown). Herein, a threaded stud 22 extends through an aperture (not shown) within the mounting surface into threaded engagement with threaded aperture **31*a* within segment 27*a* of lower plate 25*a*. Nut 16 of coil spring 15 threadedly secures stud 22 into a locking relationship with segment 27*a*. A nut 33 engages stud 22 beneath the mounting surface (not shown) to draw segment 27*a* against the upper side of the mounting surface. As described above with respect to FIGS. 1 and 2, aperture 26 of an upper plate 25 is brought into mating relationship with coupling 21 and segment 28 is positioned adjacent the upper surface of nut 17. Rod 36 of lock 35 is brought into penetrating engagement with aperture 26*a* within segment 28*a* of lower plate 25*a* and into penetrating engagement with one of apertures 29, 30 or 31 of segment 27 of upper plate 25**.

As described above, rotation of coupling 21, and hence removal of antenna 20, is precluded except for commensurate rotation of upper plate 25. Rotation of upper plate 25 is precluded by lock 35 interconnecting upper plate 25 with lower plate **25*a*. Rotation of lower plate 25*a* is precluded by the friction interference relationship between segment 27*a* of the lower plate and the upper side of the mounting surface. Moreover, the interference lock created intermediate nut 16 and threaded aperture 31*a* of lower plate 25*a* precludes rotation of coil spring 15 independent of commensurate rotation of the lower plate 25. Thereby, the upper and lower plates, being essentially identical with one another but being positionally reversed, serve, in conjunction with lock 35, to preclude unauthorized disengagement of antenna 20** from its mounting platform.

Figure 6:
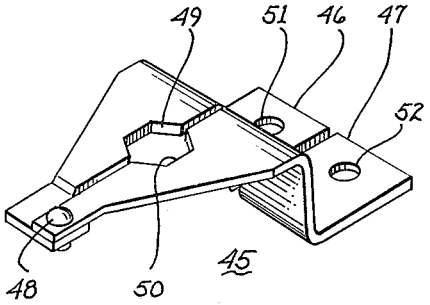
FIG. 6 is a variant of the fitting illustrated in FIG. 4.

FIG. 6 illustrates a variant of plate 25, which variant is employed wherein antenna 20 includes a loading coil disposed at its approximate mid-section. The cross-sectional configuration of such a coil is normally greater than that of coupling 21 whereby plate 25 cannot be brought into engagement with aperture 26 by first sliding the tip of antenna 20 through the aperture. Plate 45 is developed from a pair of elements 46 and 47 pivotally pinned to one another by means of a pin 48. Elements 46 and 47 include indentations 49 and 50, respectively, which, in combination, define a hexagonal aperture commensurate in size with the cross-section of coupling 21. Elements 46 and 47 also include apertures 51 and 52 corresponding in function to apertures 29 and 30 of plate 25.

Figure 7:
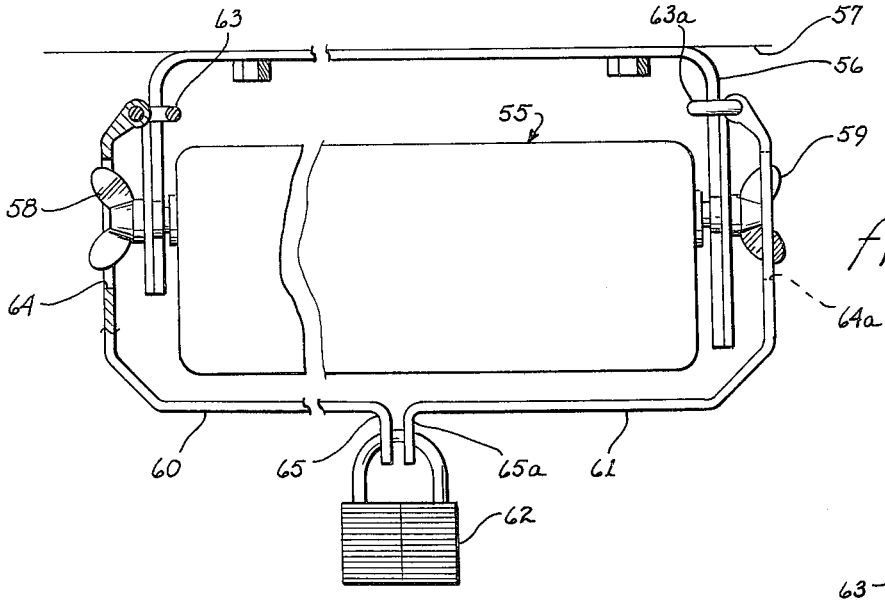
FIG. 7 illustrates lockable fittings employed to secure a conventional CB transceiver.
Figure 8:
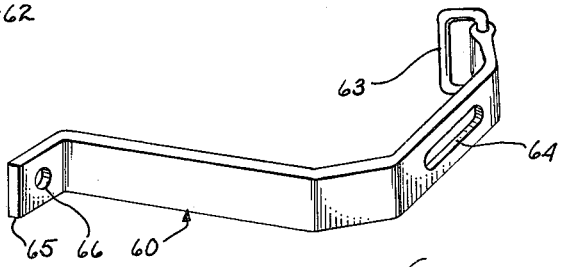
FIG. 8 is a perspective view of one of the fittings illustrated in FIG. 7.

Referring now to FIG. 7, there is illustrated a conventional CB transceiver 55 secured by thumb screws 58 and 59 to bracket 56 extending beneath the dash 57 of an automobile. Normally, transceiver 55 is removed from bracket 56 by manual unthreading of thumb screws 58 and 59 from corresponding threaded apertures within the transceiver. To preclude rotation of thumb screws 58 and 59, and thereby preclude unauthorized removal of transceiver 55 from bracket 56, a pair of locking straps 60 and 61 are secured to respective segments of bracket 56 and to one another by means of padlock 62. As shown in FIG. 8, each of straps 60 and 61 include a ring 63 pivotally attached to the upper end of the strap for receiving a downwardly extending leg of bracket 56. A slot 64 is disposed within each strap to penetratingly receive the ears of the respective one of the thumb screws. A flange 65 (65*a*) is disposed at the other end of each strap and includes an aperture 66 for receiving the hasp of lock 62.

In operation, prior to mounting of transceiver 55 within bracket 56, rings 63 and 63*a* of straps 60 and 61 are fitted upon the depending legs of bracket 56. Thereafter, the transceiver is secured to the bracket by engaging thumb screws 58 and 59 with corresponding threaded cavities within the transceiver. To permit engagement of straps 60 and 61 with the thumb screws, the latter are to be positioned in the vertical orientation illustrated. On pivoting straps 60 and 61 downwardly, the ears of the thumb screws will partially penetrate slots 64 and 64*a*, which penetration will preclude further rotation of the thumb screws. The straps are retained in their locking position by means of padlock 62 engaging the apertures of flanges 65 and 65*a*. Thereby, these simple and easily useable straps effectively lock transceiver 55 within its mounting bracket and preclude unauthorized removal of the transceiver.

Figure 9:
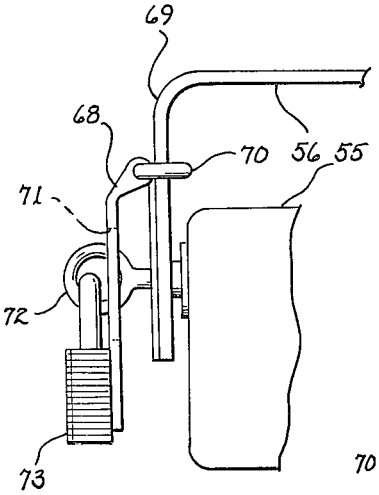
FIG. 9 illustrates a variant of the locking mechanism shown in FIG. 7.

FIG. 9 illustrates a variant of the locking straps described in FIGS. 7 and 8. Herein, a strap 68 is brought into engagement with leg 69 of bracket 56 by a pivotable ring 70. Strap 68 includes a slot 71 disposed therein. The normally employed thumb screw for attaching transceiver 55 to leg 69 of bracket 56 is replaced with an eye bolt 72. In operation, ring 70 is circumscribingly mounted upon leg 69, whereafter eye bolt 72 is employed to secure transceiver 55 to leg 69. Downward pivotal movement of strap 68 results in penetration of eye bolt 72 through slot 71. Padlock 73, engaging the eye of the eye bolt, precludes subsequent outward pivotal movement of the strap and slot 71 precludes unauthorized unthreading of the eye bolt and consequent removal of the transceiver from the bracket.

Figure 10:
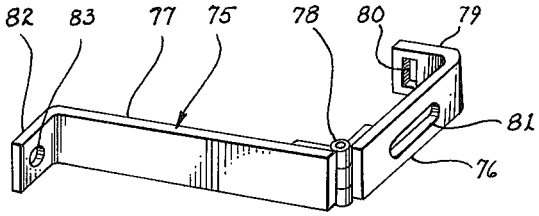
FIG. 10 illustrates a locking fitting for a transceiver which is adaptable to lock the base of an antenna to its mounting platform.

By modifying the strap illustrated in FIG. 8 to that shown in FIG. 10, it becomes possible to employ such a strap for either the purpose of securing a transceiver within its bracket or for the purpose of securing an antenna to its mounting platform (as discussed in great detail above). Strap 75 includes segments 76 and 77 pivotally attached to one another by a hinge 78. Segment 76 includes a flange 79 having an aperture 80 disposed therein. The width of aperture 80 is essentially commensurate with the width of two opposing faces of hexagonal coupling 20 (see FIGS. 1, 2, 3, and 11), and of a width commensurate with the width of a leg of bracket 56 (see FIG. 7). A slot 81 is also disposed within segment 76 to receive the ears of a thumb screw. Segment 76 includes a flange 82 having a threaded aperture 83.

When used for securing a transceiver to its bracket, a pair of straps 75 are mounted in the manner of straps 60, 61 as depicted in FIG. 7. For such use, the threads within aperture 83 are essentially of no concern. In order to describe the function of strap 75 as an antenna locking device, the plate illustrated in FIG. 2 will be first described. Plate 85 is a shallow Z-shaped plate having a threaded aperture 86 disposed within segment 87 and a conventional aperture 88 disposed within segment 89. The planar separation between segments 87 and 89 is configured to be slightly greater than that of the head of the bolt to be threadedly engaged with aperture 86.

Figure 11:
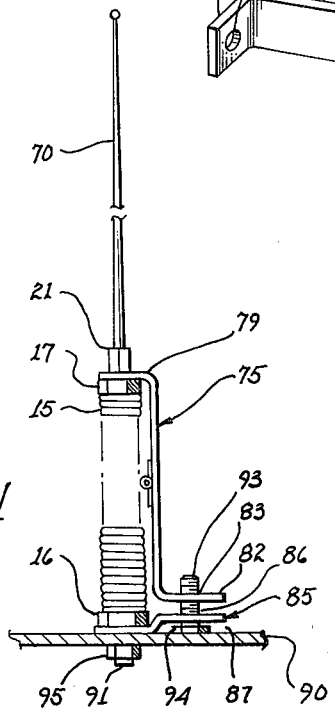
FIG. 11 illustrates the fitting shown in FIG. 10 in use to secure the base of an antenna to the mounting platform for the antenna.
Figure 12:
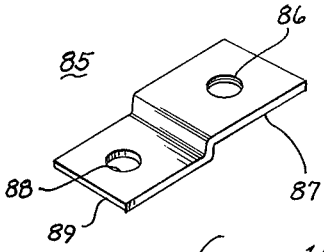
FIG. 12 is a perspective view of a further fitting used in conjunction with the mounting platform to secure an antenna thereto.

FIG. 11 illustrates an antenna 20 secured to a mounting surface 90 through deployment of strap 75 and plate 85. Prior to the securing of threaded stud 91 extending downwardly from nut 16 at the base of coil spring 15 and through mounting surface 90, aperture 80 of strap 75 is brought into engagement with coupling 21 adjacent the upper surface of nut 17. In addition, segment 89 of plate 85 is brought into engagement with the lower surface of nut 16 by inserting threaded stud 91 through aperture 88. Thereafter, flange 82 is brought into juxtaposed relationship with segment 87. A bolt 93 is sequentially threaded through apertures 86 and 83 until bolt head 94 is essentially adjacent the under surface of segment 87. The resulting assembly is mounted upon mounting surface 90 by extending stud 91 through an aperture therein and drawing the assembly against the mounting surface by nut 95.

In operation, upward vertical movement of flange 79 to allow unrestricted rotation of the coupling would be necessary to effect disengagement between aperture 80 and coupling 21. Such movement would first necessitate unthreading of bolt 93 to disengage itself from aperture 83. This is precluded because the head of bolt 93 would then descend into an interfering relationship with mounting surface 90 before the top of the bolt clears threaded aperture 83 within flange 82. Thus, coupling 21 cannot be threadedly disengaged from the threaded stud interconnecting it and nut 17 and hence removal of antenna 20 is precluded. Thereby, strap 75 is capable of serving the dual purpose of either serving as a lock for a transceiver unit or, in combination with a further plate, serving as a lock for precluding removal of an antenna.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. In threaded antenna mounting systems having a coupling interconnecting the antenna with the mounting platform extending from a mounting surface, the improvement comprising in combination:

a. a plate for circumscribingly receiving the coupling, said plate including engagement means for non-rotatably engaging the coupling and precluding independent rotation between said plate and the coupling; and b. lock means for securing said plate adjacent an element of the mounting platform;

whereby, rotation of the coupling independent of said plate is precluded by said plate and rotation of said plate resulting in unthreading and commensurate elongation of the antenna mounting platform is precluded by said lock means.

2. In a threaded antenna mounting system having a coupling interconnecting an antenna with a mounting platform extending from a mounting surface, which mounting platform includes a stud mounted swivel ball and a threadedly attached coil spring extending from the swivel ball, the improvement comprising in combination:

a. a plate for circumscribingly receiving the coupling, said plate including engagement means for non-rotatably engaging the coupling and precluding independent rotation between said plate and the coupling; and b. lock means for securing said plate adjacent an element of the mounting platform, said lock means comprising:

i. a U-shaped rod, said rod including a base for partially circumscribing the stud of the swivel ball and a pair of legs extending upwardly from said base;

ii. at least one aperture disposed within said plate for receiving one of said legs; and iii. a lock for lockingly engaging said pair of legs to prevent displacement of said plate from the stud of the swivel ball; whereby, rotation of the coupling resulting in disengagement of the antenna is precluded by said plate and said lock means.

3. In threaded antenna mounting systems having a coupling interconnecting the antenna with the mounting platform extending from a mounting surface, which mounting platform includes a stud mounted swivel ball and a threadedly attached coil spring extending from the swivel ball, the improvement comprising in combination:

a. a plate for circumscribingly receiving the coupling, said plate including engagement means for non-rotatably engaging the coupling and precluding independent rotation between said plate and the coupling; and b. lock means for securing said plate adjacent an element of the mounting platform, said lock means comprising:

i. a U-shaped rod, said rod including a base and a pair of legs extending from said base;

ii. a collar disposed about the stud of the swivel ball, said collar including aperture means for receiving said base of said U-shaped rod;

iii. at least one aperture disposed within said plate for receiving one of said legs; and iv. a lock for lockingly engaging said pair of legs to prevent displacement of said plate from said collar; whereby, rotation of the coupling resulting in disengagement of the antenna is precluded by said plate and said lock means.

4. In threaded antenna mounting systems having a coupling interconnecting the antenna with the mounting platform extending from a mounting surface, which mounting platform includes a coil spring extending from the mounting surface for the antenna and threaded means for attaching one end of the coil spring to the mounting surface and the other end to the coupling, the improvement comprising in combination:

a. a plate for circumscribingly receiving the coupling, said plate including engagement means for non-rotatably engaging the coupling and precluding independent rotation between said plate and the coupling; and b. lock means for securing said plate adjacent an element of the mounting platform, said lock means comprising:

i. a further plate secured intermediate one end of the coil spring and the mounting surface, said further plate including an aperture laterally displaced from the coil spring;

ii. a U-shaped rod, said rod including a base for penetrably engaging said aperture of said further plate and a pair of legs extending from said base;

iii. at least one aperture disposed within said plate for receiving one of said legs; and iv. a lock for lockingly engaging said pair of legs to prevent displacement of said plate from said further plate; whereby, rotation of the coupling resulting in disengagement of the antenna is precluded by said plate and said lock means.

5. In threaded antenna mounting systems having a coupling, hexagonal in cross-section, interconnecting the antenna with the mounting platform extending from a mounting surface, the improvement comprising in combination:

a. a plate for circumscribingly receiving the coupling, said plate including engagement means for non-rotatably engaging the coupling and precluding independent rotation between said plate and the coupling;

b. lock means for securing said plate adjacent an element of the mounting platform; and c. said plate comprising:

i. a Z-shaped plate having first and second segments;

ii. said engagement means being disposed in said first segment and comprising a hexagonal hole dimensioned to mate with and receive the coupling; and iii. said second segment including aperture means for receiving said lock means;

whereby, rotation of the coupling resulting in disengagement of the antenna is precluded by said plate and said lock means.

6. The improvement as set forth in claim 5 wherein said Z-shaped plate comprises a pair of mirror image elements pivotally secured to one another at said first segment, each said element including an indentation defining one half of said hexagonal hole; whereby, mounting of said Z-shaped plate about the coupling may be made independent of the existence of loading coils upon the antenna.

7. The improvement as set forth in claim 4 wherein the coupling is hexagonal in cross-section and said plate comprises:

a. a Z-shaped plate having first and second segments;

b. said engaging means being disposed in said first segment and comprising a hexagonal hole dimensioned to mate with and receive the coupling; and c. said second segment including aperture means for receiving said lock means.

8. The improvement as set forth in claim 7 wherein said further plate and said Z-shaped plate are identical and mounted in reversed and mirror imaged relationship to one another.

9. In threaded antenna mounting systems having a coupling interconnecting the antenna with the mounting platform extending from a mounting surface, the improvement comprising in combination.

a. a plate for circumscribingly receiving the coupling, said plate including engagement means for non-rotatably engaging the coupling and precluding independent rotation between said plate and the coupling;

b. said plate comprising a strap having a first and second segment, said first segment including an apertured flange for receiving the coupling and said second segment including a flange having a threaded aperture;

c. lock means for securing said plate adjacent an element of the mounting platform, said lock means comprising:

i. an offset plate having one end secured to the mounting platform and another end displaced from the mounting surface, said other end including a further threaded aperture; and ii. a threaded bolt having a head disposed intermediate said other end and the mounting surface and a threaded shaft sequentially engaging said further threaded aperture and said threaded aperture; whereby, rotation of the coupling resulting in disengagement of the antenna is precluded by said plate and said lock means.

10. The improvement as set forth in claim 9 wherein said first and second segments of said strap are pivotally connected to one another.

* * * * *